US006817046B1

(12) United States Patent
Srour et al.

(10) Patent No.: US 6,817,046 B1
(45) Date of Patent: Nov. 16, 2004

(54) ONE HAND FOLDING CRIB

(76) Inventors: Mark Srour, 1476 E. 13$^{th}$ St., Brooklyn, NY (US) 11232; Joey Srour, 1968 E. 12$^{th}$ St., Brooklyn, NY (US) 11229

( * ) Notice: Subject to any disclaimer, the term of this patent is extended or adjusted under 35 U.S.C. 154(b) by 0 days.

(21) Appl. No.: 10/461,404

(22) Filed: Jun. 16, 2003

(51) Int. Cl.$^{7}$ ..... A47D 13/06
(52) U.S. Cl. ..... 5/99.1; 5/100; 5/93.1
(58) Field of Search ..... 5/11, 93.1, 93.2, 5/991, 100

(56) References Cited

U.S. PATENT DOCUMENTS

| | | | | | |
|---|---|---|---|---|---|
| 2,329,475 | A | * | 9/1943 | Lehman, Jr. et al. | 5/93.1 |
| 2,430,704 | A | * | 11/1947 | Brown | 5/99.1 |
| 2,487,636 | A | * | 11/1949 | Churchwell | 5/99.1 |
| 2,553,579 | A | * | 5/1951 | Harris | 5/99.1 |
| 2,561,637 | A | * | 7/1951 | Rex | 5/99.1 |
| 2,641,774 | A | * | 6/1953 | Carbee | 5/99.1 |
| 3,634,894 | A | * | 1/1972 | Harbison | 5/100 |
| 3,654,645 | A | | 4/1972 | Lee | |
| 3,680,155 | A | | 8/1972 | McMann | |
| 3,896,513 | A | | 7/1975 | Boucher | |
| 4,044,411 | A | | 8/1977 | Peterson | |
| 4,561,138 | A | | 12/1985 | Hwang | |
| 4,715,074 | A | | 12/1987 | Wallace et al. | |
| 5,040,254 | A | | 8/1991 | Frank | |
| 5,115,524 | A | | 5/1992 | Antosko | |
| 5,513,399 | A | | 5/1996 | Weng | |
| 5,761,755 | A | | 6/1998 | Huang | |
| 6,014,781 | A | | 1/2000 | Cone, II | |
| 6,185,762 | B1 | | 2/2001 | Homeyer | |

* cited by examiner

*Primary Examiner*—Michael F. Trettel
(74) *Attorney, Agent, or Firm*—Richard C. Litman

(57) ABSTRACT

The one hand folding crib includes a generally rectangular enclosure having a central opening and a mattress platform disposed within the central opening for supporting a mattress. The generally rectangular enclosure is defined by a dropside gate slidably mounted on a pair of front corner posts, a rear wall fixed to a pair of rear corner posts, and a pair of collapsible, folding end walls that extend between the front and rear corner posts. Each end wall comprises a pair of hinged end panels that are hingedly attached to each other and to the adjacent corner posts. The mattress platform is pivotally attached to the rear corner posts. In order to collapse or fold the crib, the mattress platform may be swiveled upwards and each end wall may be inwardly folded.

19 Claims, 11 Drawing Sheets

ONE HAND FOLDING CRIB

BACKGROUND OF THE INVENTION

1. Field of the Invention

The present invention relates to a baby crib, and more particularly to a foldable baby crib having a pivotal mattress support or mattress platform.

2. Description of the Related Art

There is frequently a need for moving baby beds, play pens, and changing stations, from place to place. While there are a number of different collapsible cribs available on the market to facilitate transporting or storage, many of these products require significant manipulation and effort before a crib may be collapsed into a folded configuration or assembled from a folded configuration. Additionally, conventional collapsible cribs are prone to being folded or collapsed accidentally by the parent or child while in use. For example, crib gates typically have a plurality of sections which are hinged together and secured in place by a latch or other type fastener. Sometimes, however, the latch becomes disengaged from the keeper when the child shakes the crib, or the child may intentionally release the latch so that the gates fold inward, creating a pinch point at the hinged joint between the gate sections. If the child in the crib should inadvertently place his fingers between these hinged sections, and lean or push outward against the gate, his fingers may become trapped and squeezed between the two sections, causing pain and possible injury.

U.S. Pat. No. 3,680,155, issued Aug. 1, 1972 to J. R. McMann, discloses a foldable baby crib, including a mattress supporting frame with foldable legs, and foldable head and foot boards at either end of the frame. The crib sides, which normally extend upwardly from the frame, are adapted for vertical sliding as well as pivotal movement over the mattress supporting frame.

U.S. Pat. No. 3,896,513, issued Jul. 29, 1975 to R. W. Boucher, discloses a foldable infant's crib that is fitted with special end gate locks, leg locks, drop gate locks., and a special floor panel. The crib has front and rear gates connected by hinged sectional end gates to form a rectangular enclosure. Posts at the four corners of the crib support extensible legs so that the crib can be positioned at various elevations above the floor. A complicated latch mechanism must be operated in order to move or adjust the height of floor panel.

U.S. Pat. No. 4,715,074, issued Dec. 29, 1987 to D. R. Wallace et al., discloses a crib in which the mattress can be selectively supported at two different heights with respect to the sides of the crib. In one embodiment, the mattress support is a sheet of plywood securely held in a groove in each of the facing end gables. The front wall is a drop side wall slidably secured to the end gables. To change the height of the mattress, the drop side front wall is slidably removed, the sheet of plywood is slid out of one groove and slid into another groove, and the dropside front wall is again slidably secured to the end gables.

U.S. Pat. No. 5,040,254, issued Aug. 20, 1991; to A. J. Frank, discloses a crib including a top frame and a base panel. The crib side walls each comprise a pair of hinged side panels which are hinged to each other, to the base panel, and to the top frame so that the side walls collapse inwardly, drawing the base and top frame together. The crib includes two end panels which are hinged to the top frame in order to rotate inwardly from a vertical position to a horizontal position on the same plane as the top frame.

Other patents relating to foldable cribs include U.S. Pat. No. 3,654,645, issued Apr. 11, 1972 to B. D. Lee (foldable crib adapted to accordion fold into a package having the general shape of an ordinary suitcase); U.S. Pat. No. 4,044,411, issued Aug. 30, 1977 to J. G. Peterson (portable folding crib housed in a suitcase or similar piece of luggage); U.S. Pat. No. 4,561,138, issued Dec. 31, 1985 to T. Hwang (foldable baby bed comprising a foldable bed frame and a foldable bed base); U.S. Pat. No. 5,115,524, issued May 26, 1992 to H. B. Antosko (folding crib mode from cardboard material); U.S. Pat. No. 5,513,399, issued May 7, 1996 to K. Weng (folding play crib); U.S. Pat. No. 5,761,755, issued Jun. 9, 1998 to L. Huang (foldable devices for a crib frame assembly); U.S. Pat. No. 6,014,781, issued Jan. 18, 2000 to R. Cone II (portable juvenile crib); and U.S. Pat. No. 6,185,762 B1, issued Feb. 13, 2001 to S. Homeyer (collapsible baby bed including a fabric cover which covers a collapsible tubular frame).

None of the above inventions and patents, taken either singly or in combination, is seen to describe the instant invention as claimed. Thus a one hand folding crib solving the aforementioned problems is desired.

SUMMARY OF THE INVENTION

The one hand folding crib is a crib having folding end walls and a pivotally mounted mattress platform. The crib defines a generally rectangular enclosure formed by a front dropside gate, a fixed rear sidewall, a pair of collapsible, folding end walls, and a mattress platform pivotally attached to the posts supporting the rear sidewall. Each end wall comprises a pair of hinged end panels attached to the adjacent corner posts by hinges. The mattress platform includes a panel mounted on a frame. The frame is pivotally attached to the rear corner post by pins. When folded down, the front edge of the frame rests on pins extending from the front corner posts.

The mattress platform serves to maintain each end wall in its fully open position. In order to collapse or fold the crib, the mattress platform may be swiveled upwards and each end wall may be inwardly folded for compact storage. The corner posts are mounted on casters so that the crib is portable.

In another embodiment, each of the rear corner posts is provided with a height adjustment track. The height adjustment track allows for height adjustment of the mattress platform without removal of the mattress platform from the crib. By adjusting the height of the mattress platform, the crib may be transformed from an infant's bed to a playpen or to a changing station. To employ the crib as a changing station, the mattress platform is raised so that a caregiver may attend to a baby in the crib without having to stoop or undergo excessive strain. To employ the crib as a playpen, the panel is lowered to ensure that the baby playing in the playpen will not climb over the crib walls.

Accordingly, it is a principal object of the invention to provide a one hand folding crib which is easily collapsible with one hand.

It is another object of the invention to provide a one hand folding crib which will not collapse or fold while in use.

It is a further object of the invention to provide a one hand folding crib that can be configured into a playpen.

Still another object of the invention is to provide a one hand folding crib that can be configured into a changing station.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
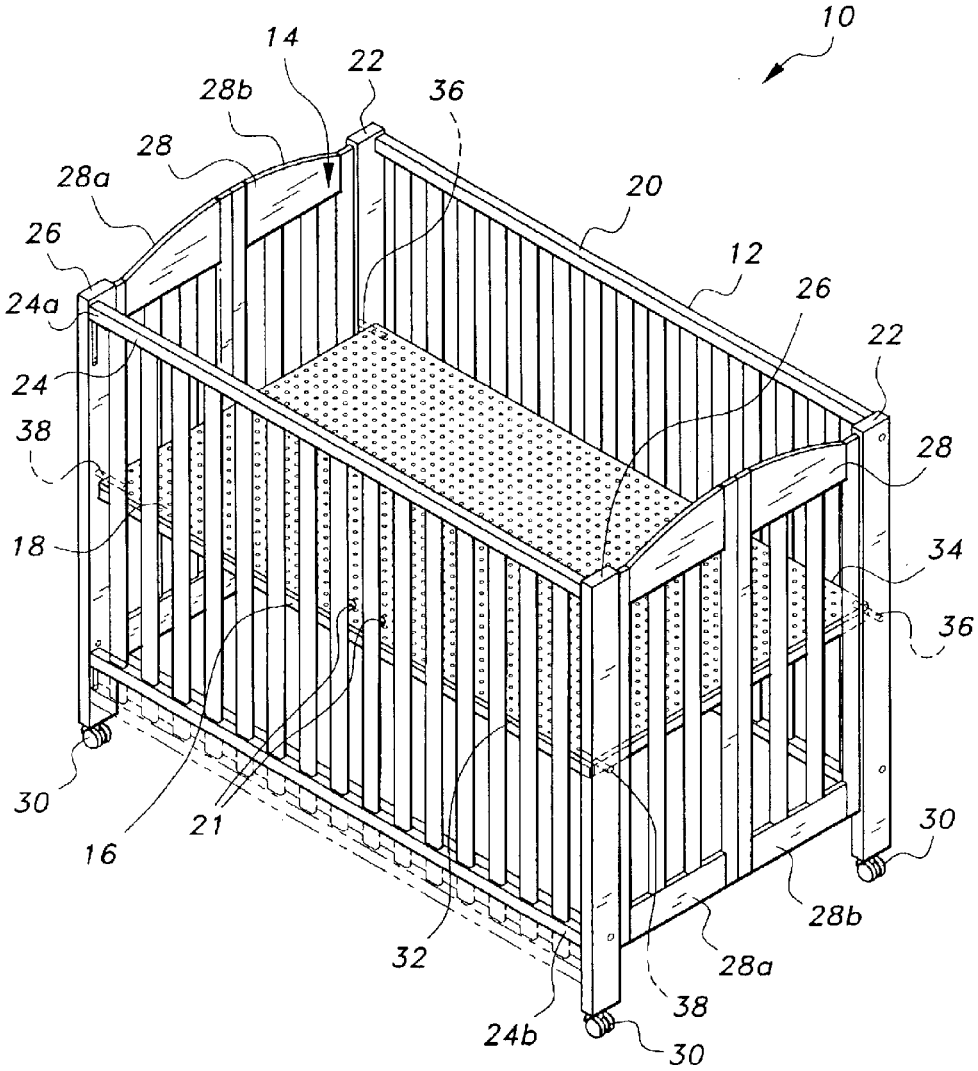
FIG. 1 is an environmental, perspective view of the one hand folding crib according to the present invention.

The present invention relates to a one hand folding crib generally designated as 10 in the drawings. As shown in FIG. 1, the one hand folding crib 10 includes a generally rectangular enclosure 12 having a central opening 14 and a mattress platform 16 disposed within the central opening 14 for supporting a mattress. The mattress platform 16 includes a frame (best seen in FIG. 6) and a continuous panel 18 affixed thereto to support the mattress. The panel 18 can be a sheet of pegboard, hardboard (perforated or solid), plywood or other suitable material. The panel 18 is provided with a pair of handle holes 21 to facilitate lifting the mattress platform 16.

The rectangular enclosure 12 is defined by a rear wall 20 fixed between a pair of rear corner posts 22, a front dropside gate 24 disposed parallel to the rear wall 20 and slidably mounted on a pair of front corner posts 26, and a pair of end walls 28 that extend between the rear and front corner posts 22 and 26 respectively. Each end wall 28 comprises a pair of end panels 28*a* and 28*b* that are attached to each other by hinges and which are also attached to the adjacent corner posts 22 and 26 by hinges. The hinge plates are mortised into the frame of the end panels 28*a*, 28*b* and also into the corner posts 22, 26, so that when the end walls 28 are extended, the end panels 28*a*, 28*b* closely approximate each other and the corner posts 22, 26, leaving insufficient space for the baby to accidentally catch and pinch his finger. A caster 30 is attached to a lower end of each of the front and rear corner posts 22 and 26. The crib 10 is preferably made from wood, however, plastic, metal or any other suitable material may be employed.

The rear wall 20, the front dropside gate 24, and the panels 28*a*, 28*b* of the end walls 28 each are of conventional construction having parallel top and bottom rails, parallel side posts, and a plurality of spaced apart slats.

Figure 2:
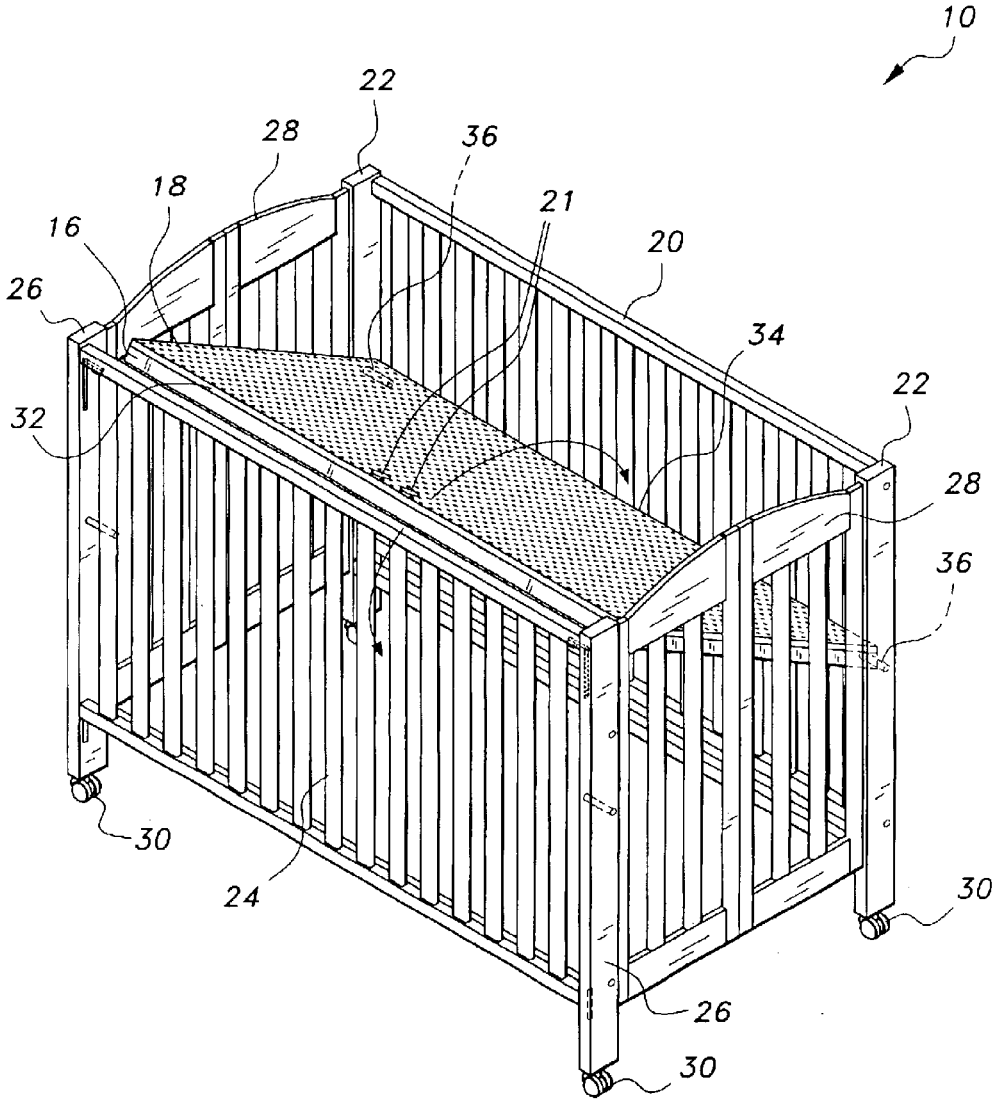
FIG. 2 is a perspective view of the one hand folding crib according to the present invention showing the mattress platform being pivoted.

The mattress platform 16 includes a generally rectangular frame having front and rear edges 32 and 34, respectively. As shown in FIG. 2, the rear edge 34 of the mattress platform is pivotally connected to the rear corner posts by pivot pins 36. The mattress platform 16 may thereby rotate from a lowered, horizontal position to a raised, vertical position.

Figure 3:
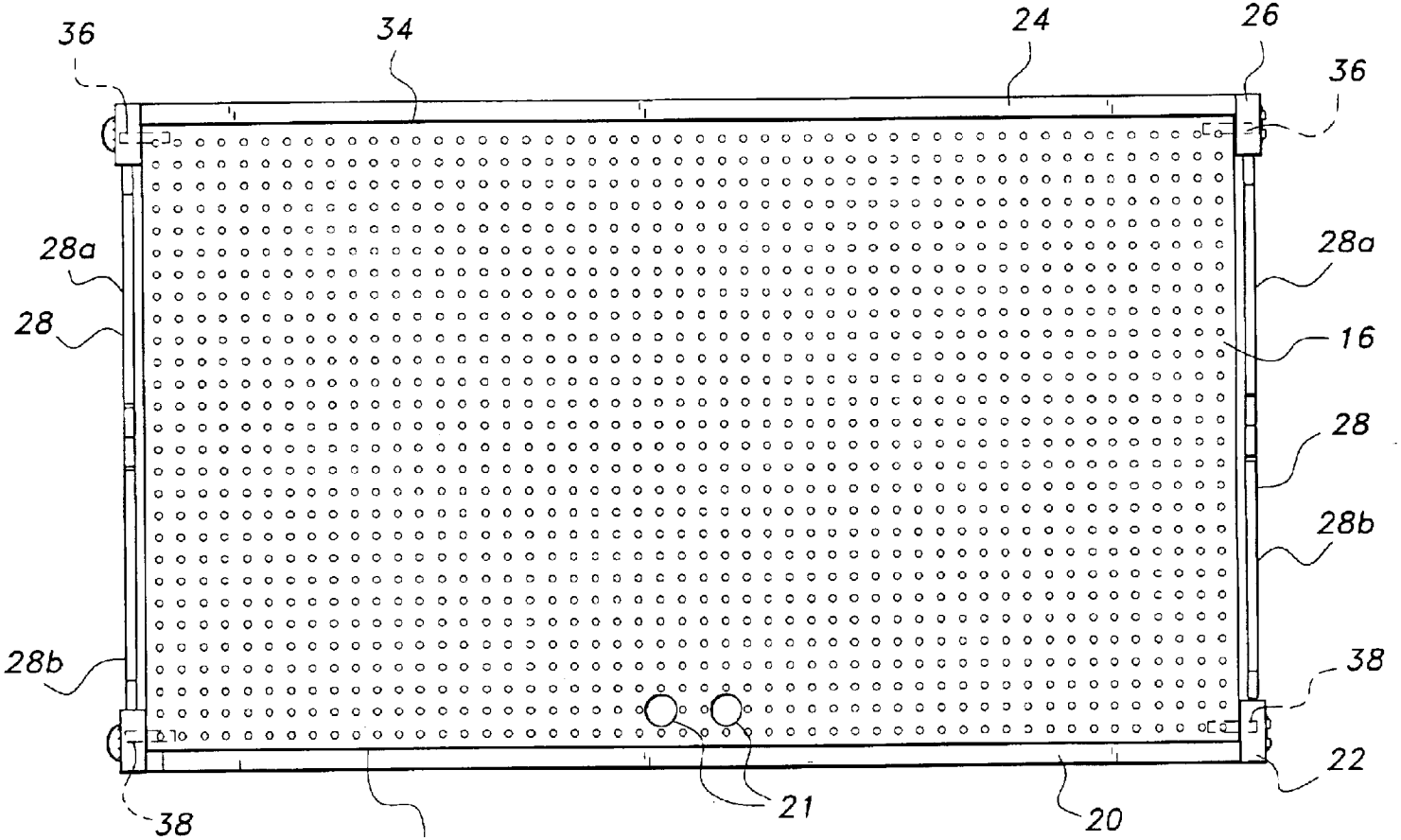
FIG. 3 is a plan view of the one hand folding crib according to the present invention showing the mattress platform in a horizontal position.
Figure 4:
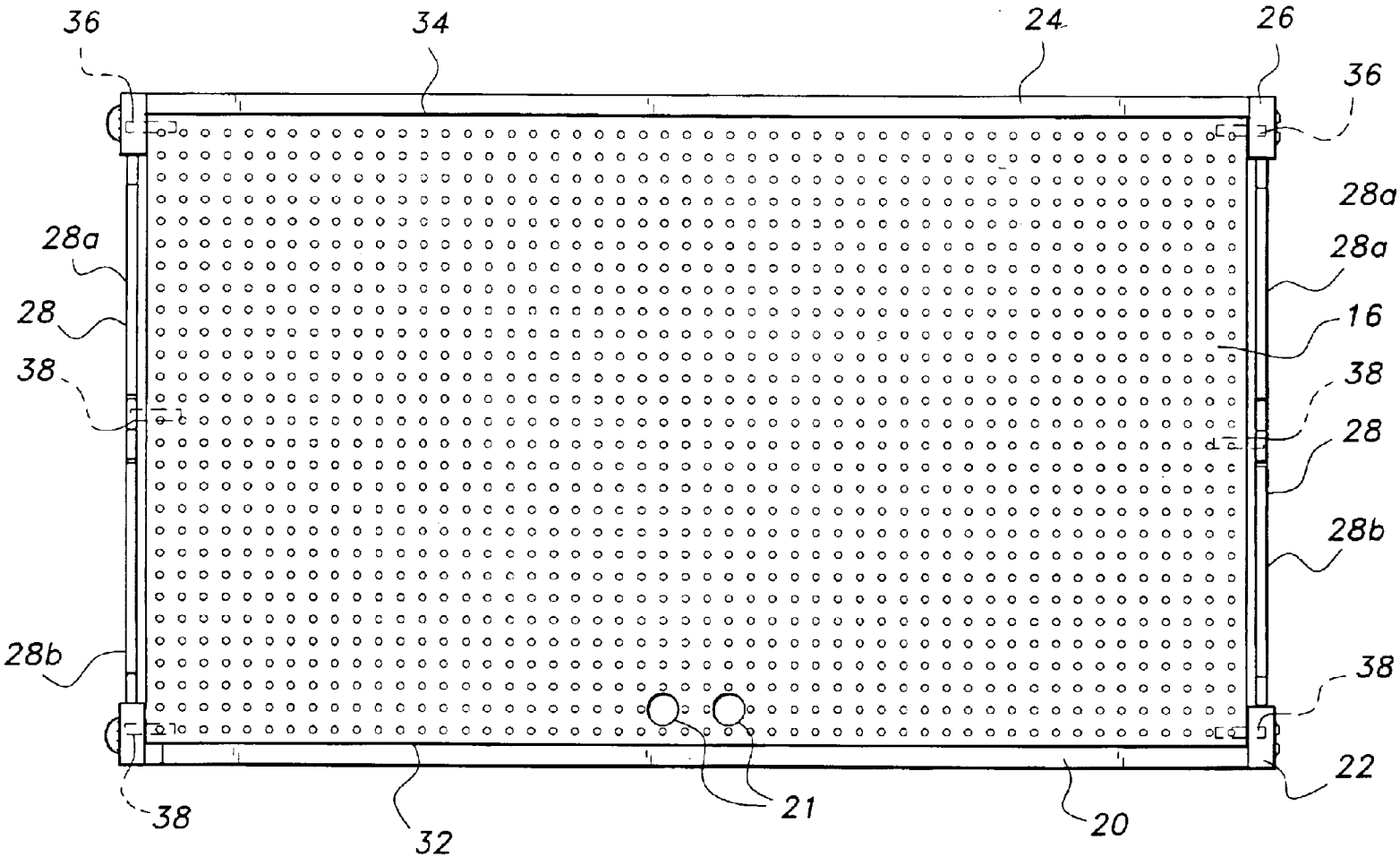
FIG. 4 is a plan view of the one hand folding crib according to the present invention showing the mattress platform in a horizontal position and support pins extending from the end gates.

FIG. 3 depicts a plan view of the crib 10 when the mattress platform is in a horizontal position 16. As can be seen, support pins 38 extending from each of the front corner posts 26 are employed to support the front edge 32 of the mattress platform 16. Additional support pins 38 may optionally be provided at opposing end walls 28, as depicted in FIG. 4, to provide additional support for the mattress platform. As depicted, when the mattress platform 16 is in the horizontal position, the mattress platform 16 abuts the end walls 28, leaving virtually no room for the end walls 28 to fold inwardly. Thus, the mattress platform 16 serves to maintain each end wall 28 in its fully open position while the crib 10 is in use, thereby eliminating the need for additional latches or locks.

Figure 5:
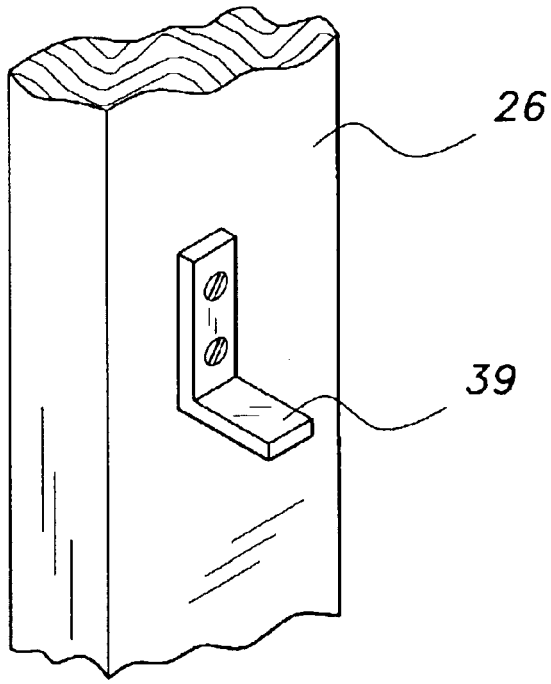
FIG. 5 is a fragmented perspective view of a front corner post according to the present invention showing an L-shaped bracket affixed thereto.

Preferably the support pins 38 are formed from internally threaded sleeves that are threaded onto screws extending through the front corner posts 26; however, instead of pins 38, other suitable support structures may be employed. FIG. 5 depicts an L-shaped bracket 39 that may be used, instead of pins 38, to support the frame of the mattress platform 16.

Figure 6:
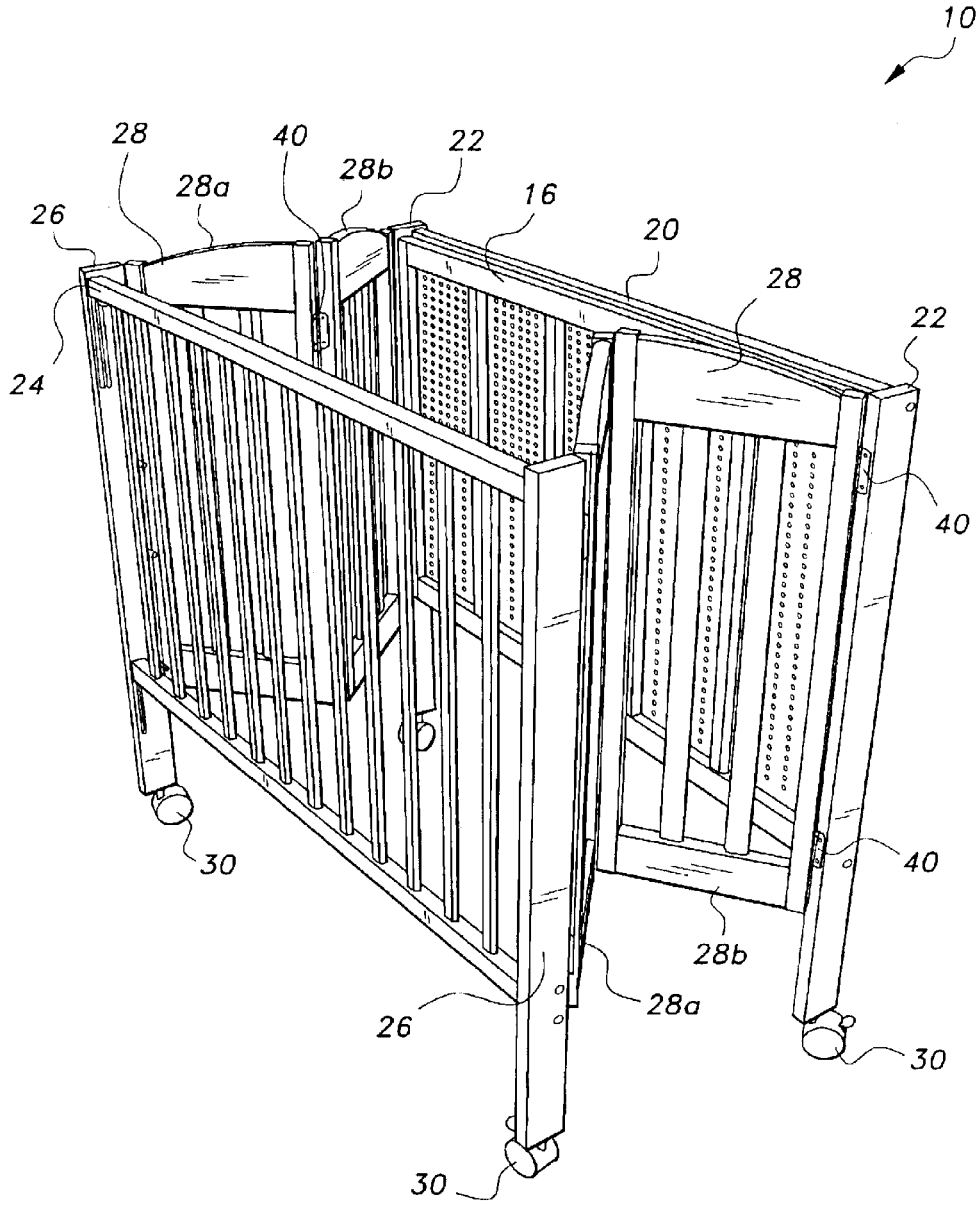
FIG. 6 is a perspective view of the one hand folding crib according to the present invention showing the mattress platform in a vertical position and the end walls partially folded.

In order to collapse or fold the crib 10, the mattress platform 16 is raised and each end wall 28 is inwardly folded as shown in FIG. 6. In this figure, hinges 40, which are used to connect end panels, 28*a* and 28*b* to each other and the adjacent corner posts 26 and 22, can be seen more clearly. Preferably, the hinges 40 have the hinge plates mortised into the supporting posts.

Figure 7:
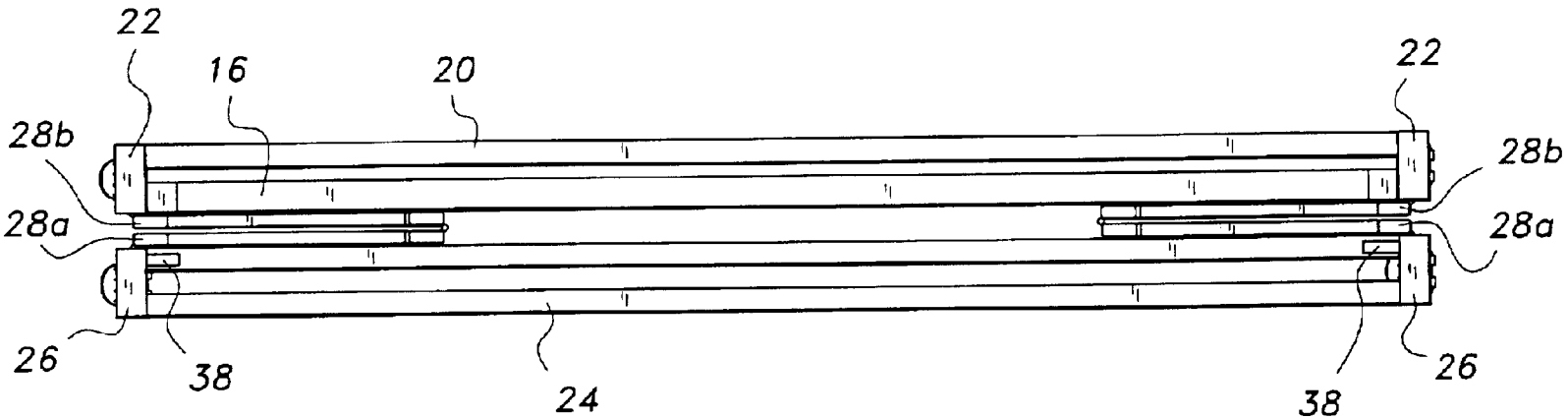
FIG. 7 is a plan view of the one hand folding crib according to the present invention showing the mattress platform in a vertical position and the end walls completely folded.

FIG. 7 depicts a plan view of the crib 10 when the crib 10 is folded and the mattress platform 16 is in the vertical position. As can be seen, when the mattress platform 16 is in the raised, vertical position, the mattress platform 16 abuts the rear wall 20 and fits between the rear corner posts 22. As seen in FIG. 7, the width of the rear posts 22 is sufficient to tuck the mattress platform inside the post 22 in the folded position.

Figure 8:
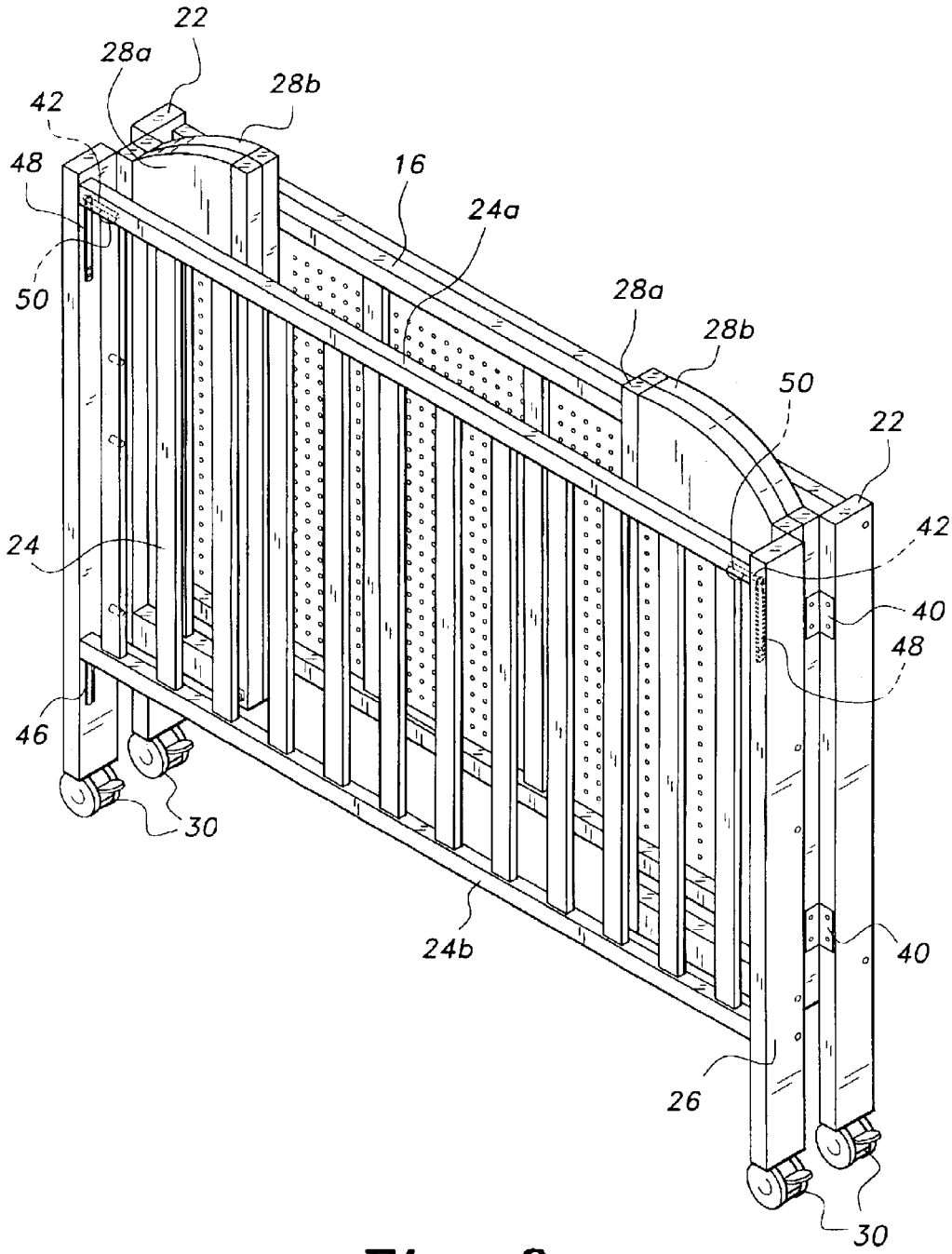
FIG. 8 is a perspective view of the one hand folding crib according to the present invention showing the mattress platform in a vertical position and the end walls completely folded.

FIG. 8 depicts a perspective view of the crib 10 when the crib 10 is folded. In this view, the dropside gate 24 is also more clearly depicted. As can be seen, the dropside gate 24 includes an upper rail 24*a* and a lower rail 24*b*. While any suitable structures may be employed to slidably mount the dropside gate 24 to the front corner posts 26, preferably, a first pair of spring loaded pins 42 is provided at opposing ends of the upper rail 24*a* for engagement with a pair of upper tracks 44 that are disposed on the front corner posts 26. The upper tracks 44 preferably include an elongated keyhole recess or groove 48 which is configured to releasably lock the spring loaded pins in a raised or lowered position. Another pair of pins (not shown) extending from the lower cross rail 24*b* slidably engage a lower pair of tracks 46 on the front corner posts 26 in a conventional manner to allow the dropside gate to be moved between raised and lowered positions. The spring loaded pins 42 may be released from a locked position by pulling on knobs 50 which are connected to the spring loaded pins 42. Positioning the pins 42 at a lower end of the elongated keyhole recess 48 lowers the dropside gate 24.

Preferably, the rear wall 2C is fixedly attached to the rear corner posts 22. Alternatively, however, the rear wall 20 may be slidably mounted to the rear corner posts 22 in a manner similar to that which is described for slidably mounting the dropside gate 24 to the front corner posts 26.

Figure 9:
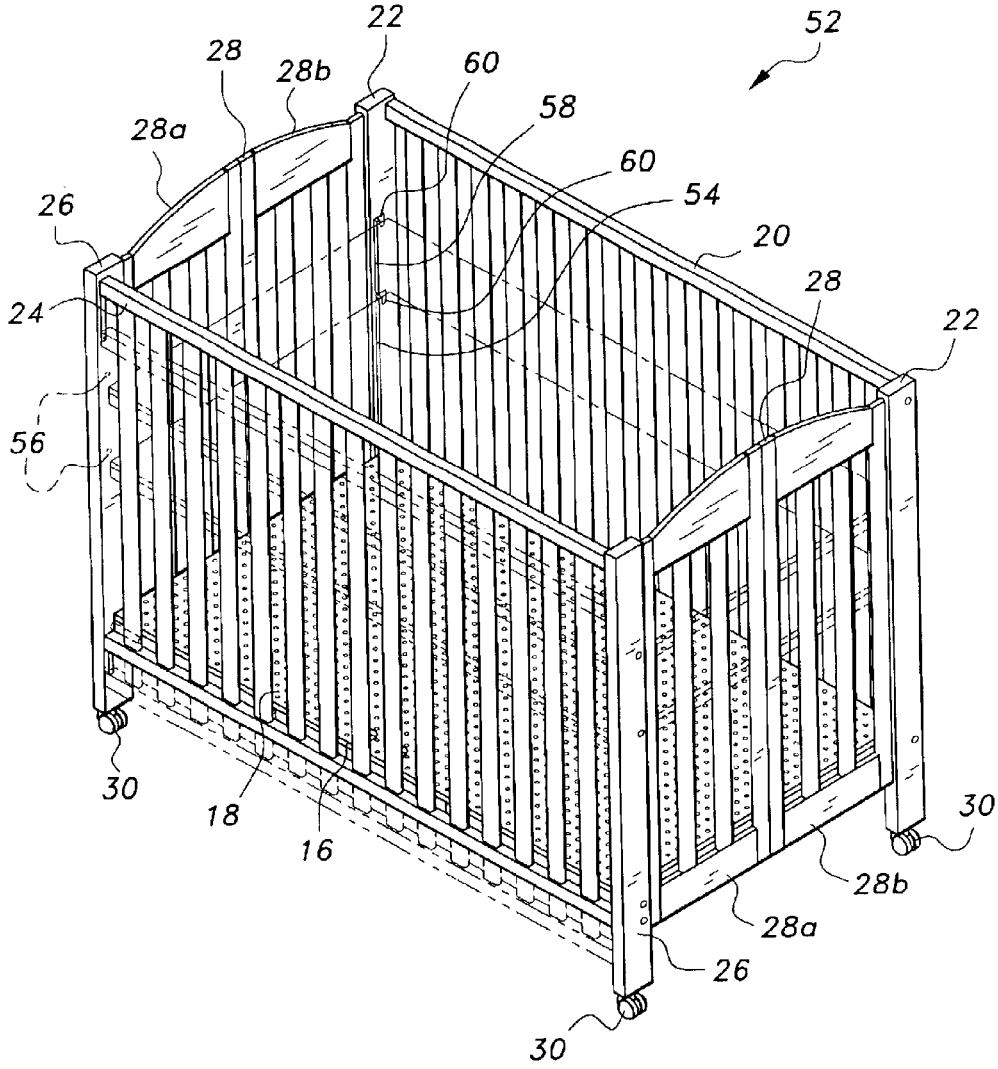
FIG. 9 is a perspective view of a one hand folding crib according to a second embodiment of the present invention showing the multiple mattress platform positions.

FIG. 9 shows a second embodiment of the one hand folding crib, generally designated as 52. This embodiment is identical to the one hand folding crib 10 except that the rear corner posts 22 are provided with height adjustment grooves 54 and the front corner posts 26 are provided with apertures 56 to facilitate height adjustment of the mattress platform 16. Identical components will not be further described. The height adjustment grooves 54 each include a vertical portion 58 and a plurality of L-shaped stop slots 60 extending horizontally from the vertical portion 58. The L-shaped stop slots 60 and the apertures 56 represent different positions to which the mattress platform 16 can be raised or lowered. Although not shown, a latch can be provided at either end wall 28 to prevent the end walls 28 from folding inwards while the height of the mattress platform 16 is being adjusted. Additionally, handle holes 21 may be provided at the rear edge 34 of the mattress platform 16, to facilitate removal of the mattress platform 16.

Figure 10:
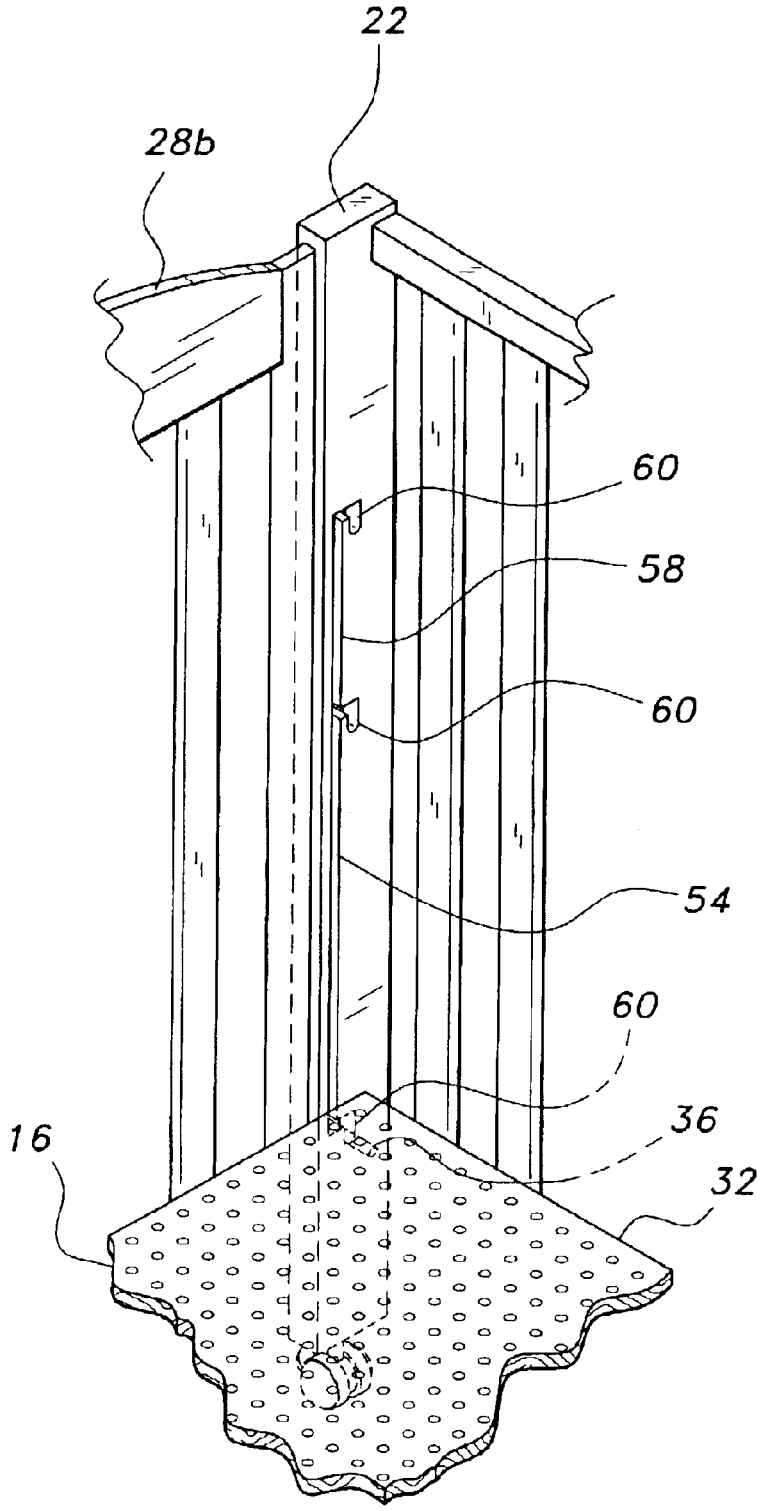
FIG. 10 is a fragmented perspective view of a rear corner post according to the second embodiment of the present invention showing the height adjustment groove.

FIG. 10 more clearly depicts one of the height adjustment grooves 54. The height adjustment grooves 54 may be indentations defined within the rear corner posts 22. Alternatively, however, the height adjustment grooves 54 may be brackets that are affixed to the rear corner posts 22. As can be seen, the L-shaped stop slots 60 are configured to receive the pivot pins 36 protruding from the rear edge 32 of the mattress platform 16. To adjust the height of the mattress platform, the mattress platform is swiveled upwards into a vertical position and slidably moved so that the pivot pins slide out of one pair of stop slots and into another. Consequently the height of the mattress platform 16 can be adjusted without removing the mattress platform from the crib.

Figure 11:
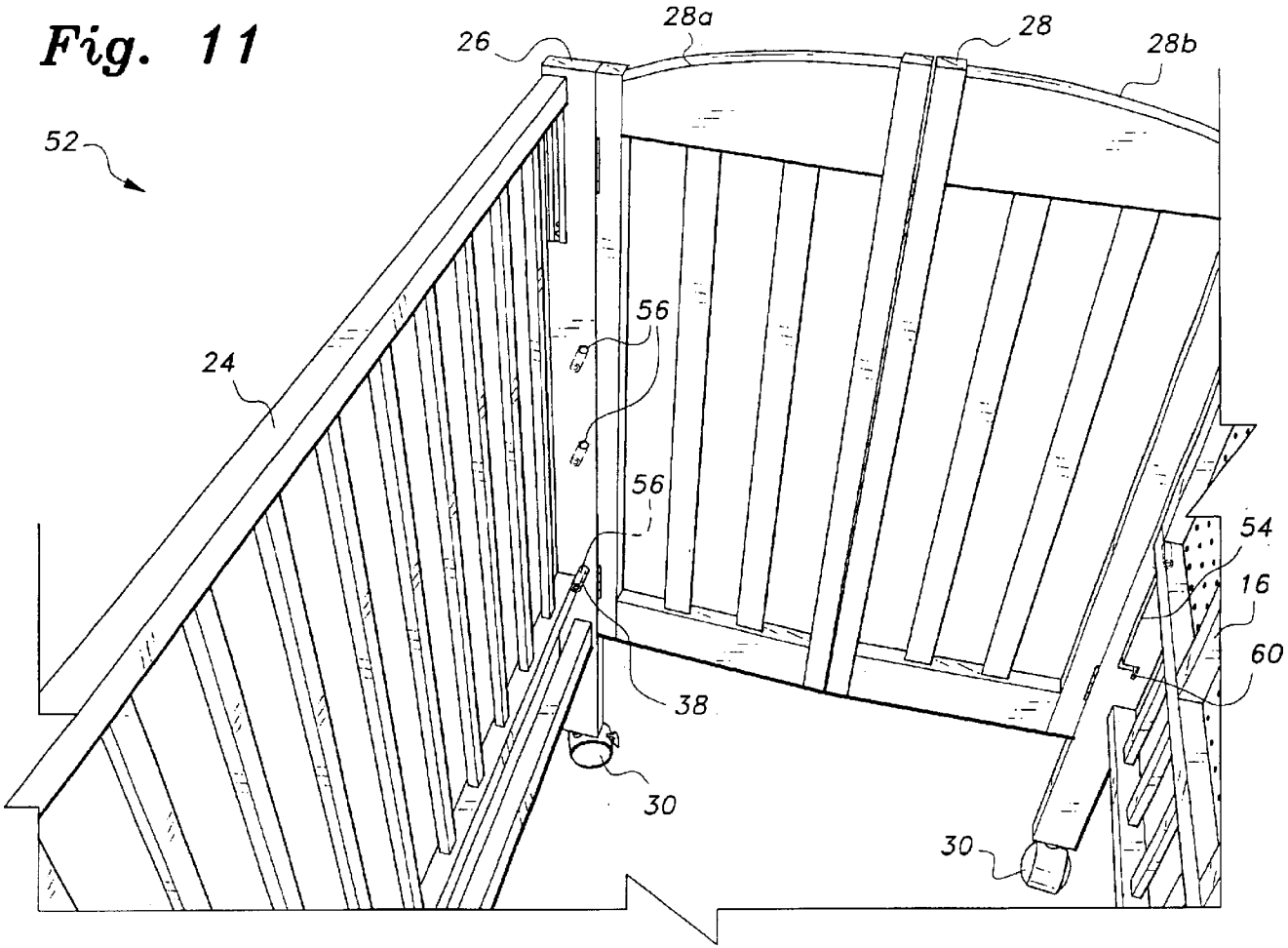
FIG. 11 is a fragmented top view of the one hand folding crib according to the second embodiment of the present invention showing additional details of the corner posts.

FIG. 11 more clearly depicts the apertures 56 on one of the front corner posts 26. The apertures 56 are configured to receive support pins 38 which support the front edge 32 of the mattress platform 16. Although support pins 38 as described above may be used, alternatively spring loaded pins (not shown) may be used to support the front edge of the mattress platform 16. The spring loaded pins can be provided at the front edge 32 of the mattress platform 16 so that they may be releasably inserted into the apertures 56 when the mattress platform 16 is in a horizontal position.

It is to be understood that the present invention is not limited to the embodiments described above, but encompasses any and all embodiments within the scope of the following claims.

We claim:

1. A one hand folding crib, comprising:

a pair of rear corner posts;

a rear wall fixed between said rear corner posts;

a pair of front corner posts;

a dropside gate having two opposing side edges, said dropside gate being slidably attached to said front corner posts;

said dropside gate further including an upper rail and a first pair of spring loaded pins disposed within said upper rail;

each said front corner post further including an upper track having an elongated key hole recess said first pair of spring loaded pins engaging said upper tracks for slidably connecting said dropside gate with said front corner posts;

a pair of end walls extending between and connecting said rear and front corner posts to define a rectangular enclosure having a central opening, each said end wall having a pair of end panels and a plurality of hinges attaching the end panels to each other and to the adjacent corner posts;

a mattress platform having a rear edge and a front edge, the rear edge of said mattress platform being pivotally connected to said rear corner posts;

whereby said mattress platform may rotate from a vertical position abutting the rear wall to a horizontal position in which said mattress platform abuts said end walls and thereby prevents said end walls from folding inwards.

2. The one hand folding crib of claim 1, wherein the hinges of said end walls have hinge plates mortised into the end panels and corner posts.

3. The one hand folding crib of claim 1, further comprising a pivot pin connected between the rear edge of said mattress platform and each said rear corner post.

4. The one hand folding crib of claim 1, further comprising a caster attached to a lower end of each of the front and rear corner posts.

5. The one hand folding crib of claim 1, wherein said rear wall, said dropside gate, said end walls, said front and rear corner posts and said mattress platform are made from wood.

6. The one hand folding crib of claim 1, wherein said rear gate, said drop side gate, said end walls, said front and rear corner posts and said mattress platform are made from plastic.

7. The one hand folding crib of claim 1, wherein said rear wall, said dropside gate, said end walls, said front and rear corner posts and said mattress platform are made from, metal.

8. The one hand folding crib of claim 1, wherein each of said front corner posts further includes a horizontal support structure for supporting the front edge of said mattress platform when said mattress platform is disposed in a horizontal position.

9. The one hand folding crib of claim 8, wherein each said horizontal support structure comprises a screw and an internally threaded sleeve attached to the screw, thereby defining a support pin.

10. The one hand folding crib of claim 1, wherein each said end wall comprises a horizontal support structure.

11. The one hand folding crib of claim 10, wherein each said horizontal support structure comprises a screw and an internally threaded sleeve attached to the screw, thereby defining a support pin.

12. The one hand folding crib of claim 1, wherein said mattress platform comprises a frame and a continuous panel attached to the frame.

13. The one hand folding crib of claim 12, wherein said continuous panel is a sheet of pegboard.

14. The one hand folding crib of claim 12, wherein said continuous panel is a sheet of perforated hardboard.

15. The one hand folding crib of claim 12, wherein said continuous panel has at least one handle hole defined therein.

16. A one hand folding crib comprising:

a pair of rear corner posts;

a rear wall fixed between said rear corner posts;

a pair of front corner posts;

a dropside gate having two opposing side edges said dropside gate being slidably attached to said front corner posts;

a pair of end walls extending between and connecting said rear and front corner posts to define a rectangular enclosure having a central opening each said end wall having a pair of end panels and a plurality of hinges attaching the end panels to each other and to the adjacent corner posts;

a mattress platform having a rear edge and a front edge, the rear edge of said mattress platform being pivotally connected to said rear corner posts;

each said rear corner post has a height adjustment groove defined therein, the height adjustment groove comprising a vertical portion and a plurality of L-shaped stop slots extending horizontally from said vertical portion; and each said front corner post includes means for supporting the front edge of said mattress platform at positions corresponding to said stop slots;

whereby said mattress platform is vertically adjustable may rotate from a vertical position abutting the rear wall to a horizontal position in which said mattress platform abuts said end walls and thereby prevents said end walls from folding inwards.

17. The one hand folding crib of claim 16, said supporting means include apertures defined in each said front corner post and a horizontal support structure removably inserted in at least one of the apertures in each said front corner post to support the front edge of said mattress platform.

18. The one hand folding crib of claim 17, wherein said horizontal support structures comprise a pair of spring loaded pins attached to the front edge of said mattress platform for insertion through said apertures.

19. The one hand folding crib of claim 17, wherein each said horizontal support structure comprises a screw and an internally threaded sleeve attached thereto and defining a support pin.

* * * * *